United States Patent [19]

Shallman

[11] Patent Number: 4,911,346

[45] Date of Patent: Mar. 27, 1990

[54] FLEXIBLE, SEGMENTAL BACKPACK FRAME

[76] Inventor: Richard W. Shallman, 1200 N. 14th Ave., St. 400, Pasco, Wash. 99301

[21] Appl. No.: 674,149

[22] Filed: Nov. 23, 1984

[51] Int. Cl.[4] ..... A45F 3/08

[52] U.S. Cl. ..... 224/221; 224/210; 224/261; 224/153

[58] Field of Search ..... 224/211, 210, 261, 153; 273/155, 159

[56] References Cited

U.S. PATENT DOCUMENTS

| | | | |
|---|---|---|---|
| 2,825,178 | 3/1958 | Hawkins | 273/155 X |
| 2,877,506 | 3/1959 | Almoslino | 273/155 X |
| 2,925,205 | 2/1960 | Hunt . | |
| 3,282,483 | 11/1966 | Babcock . | |
| 3,355,075 | 11/1967 | Dean . | |
| 3,516,586 | 6/1970 | Farnbach . | |
| 3,885,722 | 5/1975 | Robertson . | |
| 3,921,867 | 11/1975 | Farnbach . | |
| 3,938,718 | 2/1976 | Madison . | |
| 4,015,759 | 4/1977 | Dreissigacker et al. . | |
| 4,040,548 | 8/1977 | Guglielmo . | |
| 4,133,464 | 1/1979 | Kelty . | |
| 4,135,654 | 1/1979 | Chu . | |

FOREIGN PATENT DOCUMENTS

| | | | |
|---|---|---|---|
| 71952 | 4/1947 | Norway | 224/210 |

*Primary Examiner*—Henry J. Recla

*Attorney, Agent, or Firm*—Andrus, Sceales, Starke & Sawall

[57] ABSTRACT

A backpack frame utilizes frame members formed of a plurality of relatively movable blocks. The blocks are held in a column by a cord stressed in tension running through the blocks. The relative movement among the plurality of blocks provides flexibility to the frame.

31 Claims, 3 Drawing Sheets

FIG. 1
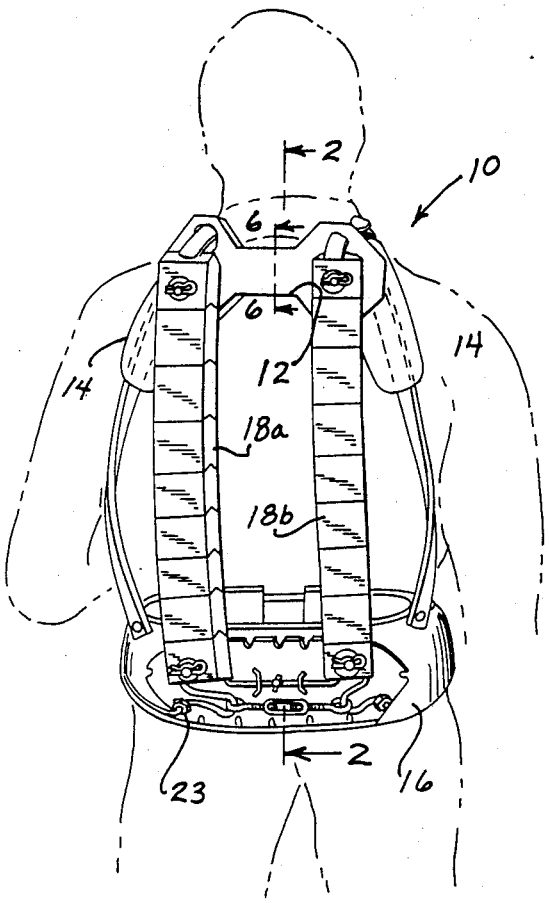
FIG. 2
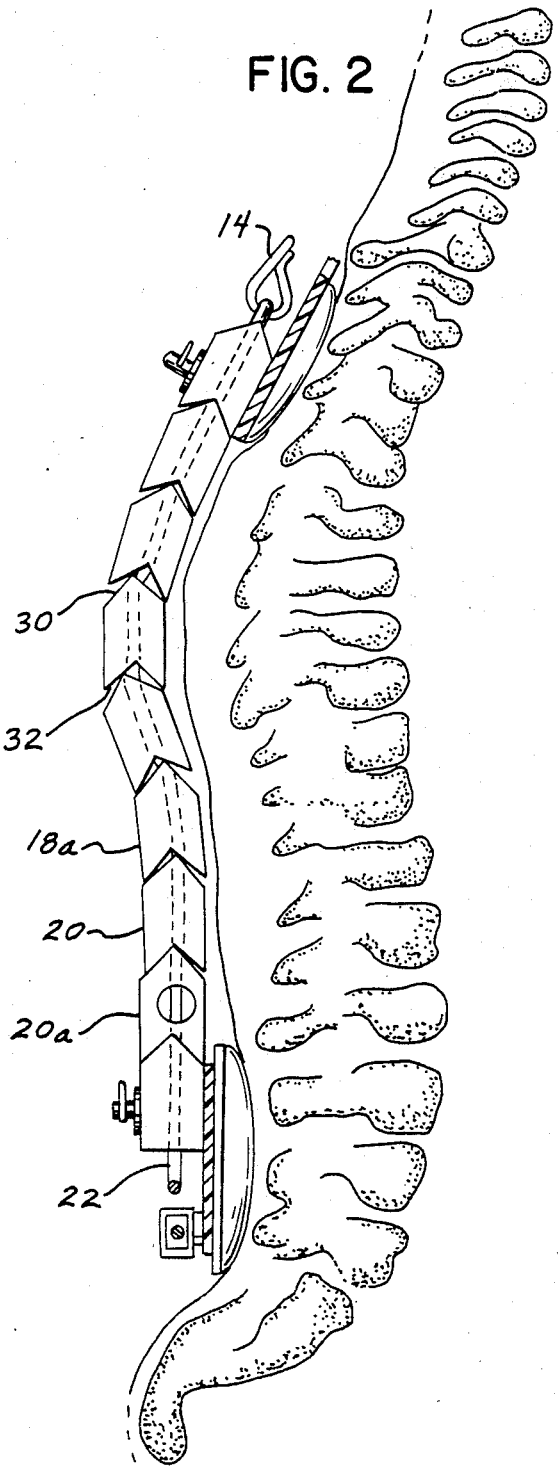
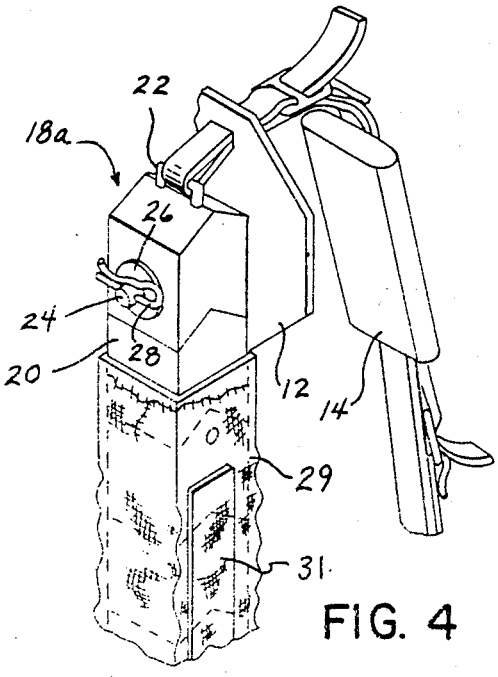
FIG. 4

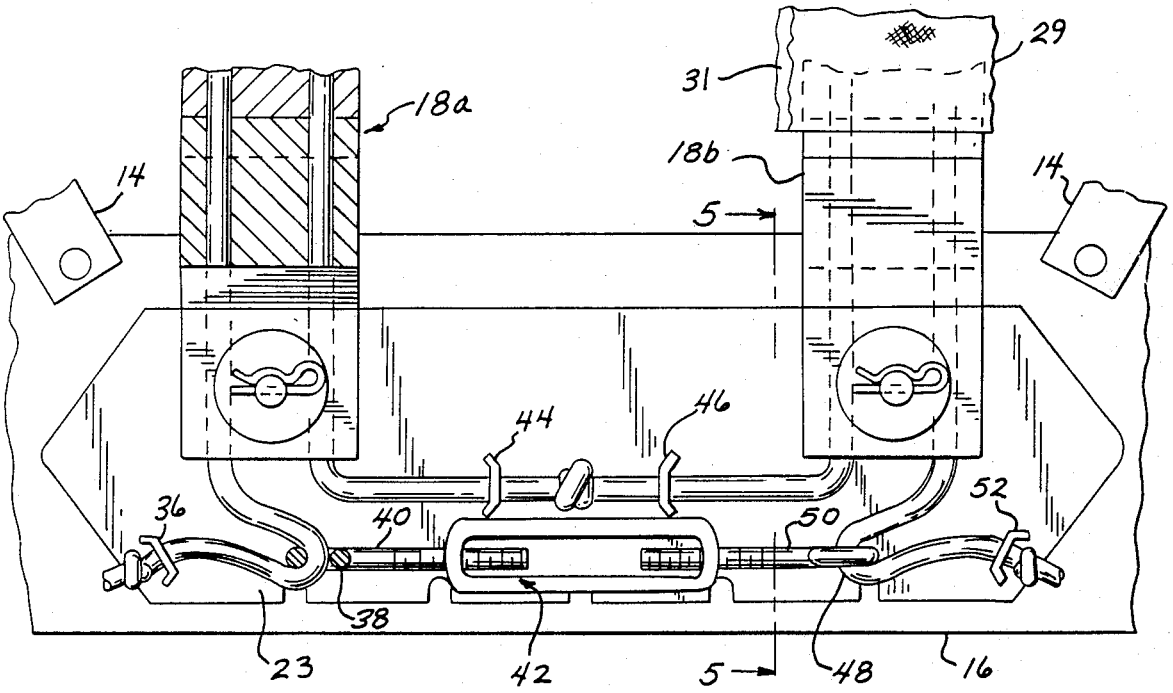
FIG. 3
FIG. 5
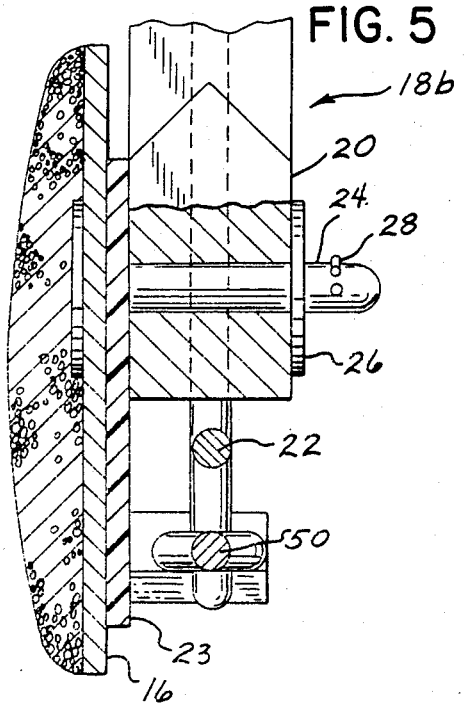
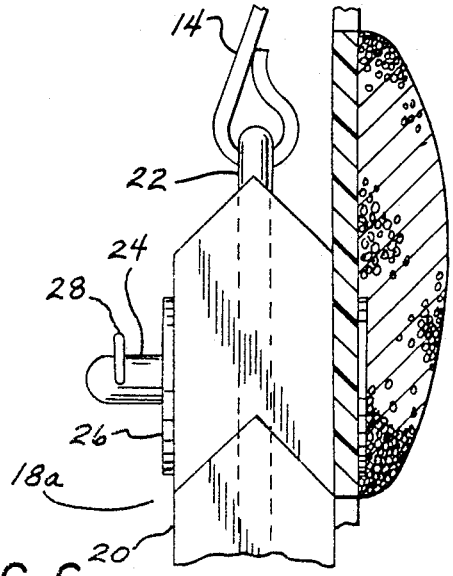
FIG. 6

FLEXIBLE, SEGMENTAL BACKPACK FRAME

The present invention relates to a backpack frame having frame members formed from relatively moveable segment so that the frame is flexible. This permits the frame to accommodate the movements of the wearer occurring during use.

Modern backpacking equipment utilizes a support, commonly called a frame. One side of the frame is placed on the user's back and fastened to the user by a harness, usually consisting of a shoulder suspension and a hip suspension. The cloth bag or pack containing the hiker's equipment is fastened to the other side of the frame. The use of a frame permits the wearer to carry heavier loads more comfortably than, for example, with a simple knapsack or rucksack.

In the past, backpack frames have typically been constructed of metal tubes that extend between the shoulder suspension and the hip suspension. Such a frame is efficient and comfortable on long trips over well established trails and gentle country.

However, for some activities a rigid, stiff frame of this type is disadvantageous. These activities include hiking in mountainous, uneven, or densely vegetated terrain, rock climbing, and crosscountry skiing. These sports are characterized by a great deal of bending or twisting by the participant which may be hampered by a rigid pack frame.

For these reasons, new designs permit some flexibility in the frame. U.S. Pat. Nos. 3,355,075; 3,885,722; 4,015,759; 4,050,548; and 4,133,464 show efforts in this direction. However, these designs do not appear to provide all the desired flexibility. They may also fail to provide the support needed to carry heavy loads efficiently. Their design and construction tends to be complex or fragile and thus prone to failure or damage in the field.

It is, therefore, the object of the present invention to provide an improved, flexible backpack frame. The frame is flexible in a very natural fashion to provide increased freedom of movement and greater comfort to the wearer and to lend an improved ability to carry heavy loads. The amount of flexibility of the frame can be easily and quickly varied to provide, for example, a stiff frame in the open country portion of a hike and a flexible frame when the user is rock climbing in the mountainous portion. The frame can be adjusted in flexibility and size to accommodate the weight of the load and the size, shape, hiking ability, and personal preference of the wearer. The frame is simple and economical in construction. It is rugged, yet light in weight, and can be easily repaired in the field, if necessary. It is easily adaptable to existing shoulder and hip suspensions.

The gist of the present invention is to provide a backpack frame that utilizes frame members formed of a plurality of relatively movable blocks. The blocks are held in a column by a cord stressed in tension running through the blocks. The columnar frame members extend between the shoulder suspension and the hip suspension. The relative movement among the plurality of blocks provides flexibility to the frame in a natural manner analogous to the flexibility of the human torso provided by the spinal column vertebrae adjacent the backpack frame when it is worn.

The amount of flexibility provided to the backpack frame may be controlled by the tension and elasticity of the cord. It may also be controlled by the shape of the blocks. The size and shape of the frame members may be established or altered by the number, size, and shape of the blocks.

The invention will be further understood by reference to the following detailed description, and the accompanying drawings.

In the drawings:

FIG. 1 is a perspective view of the flexible backpack frame of the present invention as worn by a user.

FIG. 2 is a view taken along the line 2—2 of FIG. 1 and additionally showing the spinal column of the wearer.

FIG. 3 is a detailed partial view showing the portions of the frame adjacent the hip suspension and the device for tensioning the cord;

FIG. 4 is a partial perspective view showing attachment of the shoulder straps to the frame members;

FIG. 5 is a fragmentary cross sectional view taken along the line 5—5 of FIG. 3;

FIG. 6 is a partial cross sectional view taken along the line 6—6 of FIG. 1 showing the portions of the frame adjacent the shoulder suspension;

Figure 7:
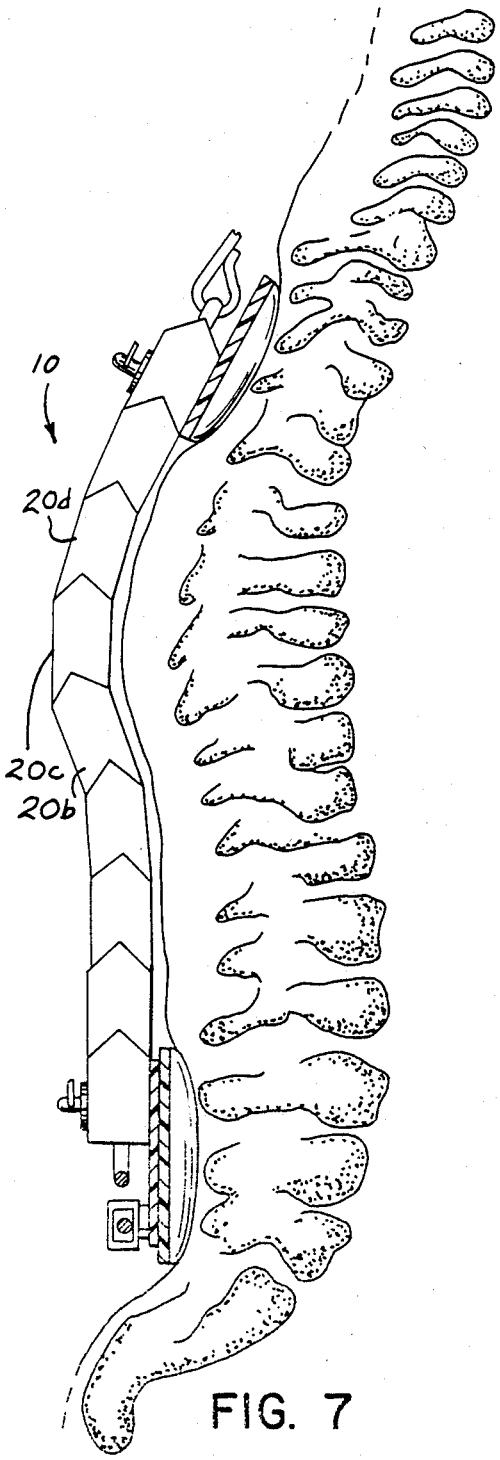
FIG. 7 is a view similar to FIG. 2 showing a modification of the flexible backpack, frame of the present invention in which the shape of the blocks is varied.

Flexible backpack frame 10 of the present invention shown in FIG. 1 includes a padded shoulder bar or plate 12 that rests in the shoulder area when the frame is worn. Shoulder straps 14 extend over the shoulders on either side of the neck of the wearer. The hip suspension comprises a padded belt 16 that rests on the hips of the wearer. The load carried by the user is thus borne partially on the shoulders by straps 14 and partially on the hips by hip belt 16.

Flexible backpack frame 10 includes a pair of laterally spaced, flexible frame members 18*a* and 18*b*. As shown in FIGS. 1 and 2, frame members 18*a* and *b* are formed of a vertical column of segments or blocks 20 held together by cord 22 extending through the blocks. Frame members 18*a* and 18*b* may be fastened to shoulder bar 12 and plate 23 on hip belt 16 by round pins 24, washers 26, and keys 28, as shown in detail in FIGS. 5 and 6. Suitable fasteners (not shown) may be provided on the shoulder and hip suspensions to attach the cloth pack containing the users equipment to frame 10. Pins 24 may be used for this purpose by mating with grommets in the pack. Frame members 18*a* and 18*b* may pass through sleeves incorporated in the pack, one of which is indicated in FIG. 3 by 29.

As shown in FIGS. 1 and 2, the upper surface of each block 20 may form a prismatic projection 30 while the lower surface has a prismatic depression 32. The prismatic projection of a given block engages in the prismatic depression 32 in the block next above it in the columnar frame member and the prismatic depression 32 of the given block receives the prismatic projection 30 of the block below it.

Blocks 20 may be formed of any suitable material having properties commensurate with desired load, performance, and cost criteria. A strong, lightweight material resistant to exposure is preferred. Suitable materials may comprise foam core plastics, fiber reinforced plastics, light weight metal, or wood. The blocks may be hollow, and/or fenestrated, if desired. Block 20*a* in FIG. 2 shows a block having an interior window to reduce weight while avoiding or minimizing loss of mechanical strength.

In the embodiment of the invention shown in the Figures, a single cord 22 is used to hold the blocks contiguous in both frame member 18*a* and frame member 18*b*. As shown in FIG. 3, plate 23 on hip belt 16 contains flange 36. One end of cord 22 extends through a hole in flange 36 and is knotted so that the cord cannot slip through the hole. Cord 22 is threaded through eyelet 38 in rod 40 of turnbuckle 42. The cord is threaded up through blocks 20 of frame member 18*a* adjacent one side of the blocks and down adjacent the other side of the blocks.

The two parallel sections of cord 22 in blocks 20 serves to bias blocks 20 into alignment. Sleeves 29, if used, also serve to align and stabilize frame members 18. The exposed loop of cord 22 at the top of the column of blocks 20 may be used to fasten shoulder straps 14 to the frame member, as shown in FIG. 4. This provides the most direct suspension of the weight of the load from the wearer's shoulders. Or, shoulder straps 14 may be fastened directly to shoulder bar 12, if desired.

Cord 22 emerging from the bottom of frame member 18*a* extends through flanges 44 and 46 on plate 23. Cord 22 is knotted between the flanges. Cord 22 extends up and down through blocks 20 of frame member 18*b*, through eyelet 48 of rod 50 of turnbuckle 42, and through flange 52 to a knotted end.

It will be appreciated that a separate cord may be used for each of frame members 18*a* and 18*b*, if desired, as by knotting the cord at the bottom inside corner of frame members 18*a* and 18*b*. However, a single cord allows better stabilizing of the sway component in the columnar frame members. Also, cord 22 may be reinforced or protected against wear by blocks 20 or turnbuckle 42 by appropriate means, such as sleeves.

In use, frame members 18 may flex, in the manner shown in FIG. 2, by virtue of the relative movement of blocks 20 with respect to each other. The stabilizing and hinging action provided by cord 22 assists in this movement. The prismatic configuration of blocks 20 permits the flexing about generally horizontal axes, while at the same time maintaining the integrity of the columnar structure. Frame members 18 can also flex in a twisting direction about an axis that is generally vertical when flexible backpack frame 10 is worn. Shoulder plate 12 and hip suspension plate 23 may be formed of flexible material. Round pins 24 permit frame members 18 to move with respect to the shoulder suspension and the hip suspension. The lateral pull applied by cord 22 to frame members 18*a* and 18*b* toward the center of plate 23 tends to pull the frame members to the vertical position. This reduces swaying of the backpack when striding.

The flexibility of frame 10 can be adjusted to accommodate particular particular conditions, loads or uses. It may also be adjusted to the athletic ability of the user or the user's personal preferences. This is accomplished by altering the compressive loading applied to blocks 20 by cord 22, as established by turnbuckle 42. By shortening turnbuckle 42, the compressive loading of the blocks in increased and the flexibility of frame member 18 is reduced. By extending turnbuckle 42, the compressive loading is reduced, and the flexibility of frame members 18 is increased. The loops of cord 22 through eyelets 38 and 48 of turnbuckle 42 provide a mechanical advantage in the controlling the compressive loading established by cord 22.

The elasticity of cord 22 is also a factor in the flexibility of frame 10. Cord 22 may be of a somewhat elastic material, such as nylon, to provide greater inherent flexibility to frame 10. Or, cord 22 may be of a material with less stretch, such as Dacron, to provide an inherently stiffer frame.

In instances in which frame members 18 are contained within sleeves 29 of the pack, the sleeves may be biased with elastic 31 or additional layers of fabric to control the flexibility of frame 10.

The prismatic configuration of blocks 20 can also be varied as a factor determinative of the flexibility of frame 10. The flexibility of the frame depends, in part, on the angle of the articulating surfaces of blocks 20. The smaller the apex angle of prismatic projection 30 and prismatic depression 32, the stiffer frame members 18 will tend to be so that the apex angle can be established in accordance with the flexibility desired in backpack frame 10 and the mechanical properties of the material used for blocks 20.

Also, the weight of the user's load compressively loads frame members 18. With heavier loads, frame 10 is stiffer. This is ordinarily desirable.

The multiple joints in frame members 18 between block 20 help to disperse shock loads and reduce strain on shoulder harness bar 12, hip belt 16, and pins 24. This lessens the likelihood that frame 10 will become damaged in use. However, if damage to one of frame members 18 does occur in the field, it can be easily repaired by replacing the damaged block 20 or cord 22. If necessary, a new block can be fashioned in the field from available materials, such as wood. The knot in cord 22 between flanges 44 and 46 on plate 34 permits one of frame members 18*a* or 18*b* to be disassembled without disassembling the other frame member.

Figure 8:
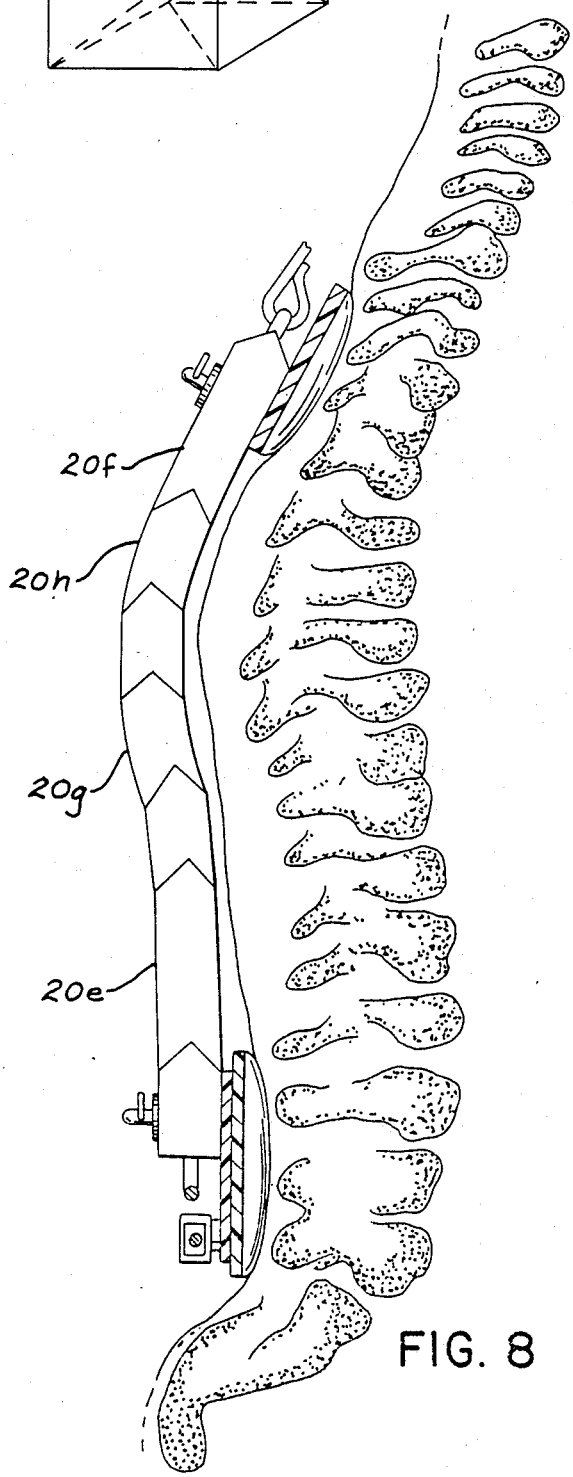
FIG. 8 is a view similar to FIG. 2 showing a modification of the flexible backpack frame of the present invention in which the shape and size of the blocks are varied.

Various modifications of the flexible backpack frame of the present invention are contemplated. For example, while FIG. 2 shows blocks 20 to be identical construction, the prismatic configuration of the blocks may vary to establish the form of the columnar structure, as shown in FIG. 7. Thus, block 20*b*, 20*c*, and 20*d* may have different prismatic configurations that provide a curve to the frame members. As will be appreciated from FIG. 7, only a small number of segments with non-standard prismatic configuration are required to obtain an appropriately shaped frame member. Or, as shown in FIG. 8, the length of blocks 20 may be varied as in blocks 20*e* and 20*f*. By providing an assortment of blocks of different shapes, for example long and short blocks, as well as straight prismatic configurations and prismatic configurations bent in increments of 5° from 5° to 30°, a custom fit to the user can be provided in backpack frame 10. Or the blocks, themselves, may be curved to form the shape of frame members 18, as in blocks 20*g* and 20*h* shown in FIG. 8.

By forming frame member 18 with the appropriate blocks, the configuration of frame member 18*a* may be made to differ from that of frame member 18*b* to accommodate persons with spinal curvatures or differences in leg length.

Blocks 20 may be added, removed, or changed in length, to accommodate different sized users of backpack frame 10, the growth of a single user, the load to be carried, or the size of the pack. The lateral spacing between frame members 18 and 18*b* may also be varied by providing a plurality of holes in shoulder harness bar 10 and plate 23 for pins 24.

Figure 9:
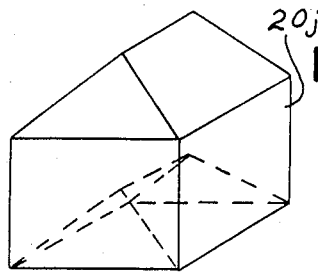
FIG. 9 is a perspective view of a block of modified form.

FIGS. 1 through 8 show a simplified form of blocks 20. The configuration and surfaces of the blocks can be varied. For example, FIG. 9 shows a truncated prismatic configuration for block 20*j*. More complicated configurations with additional facets, curved surfaces, or interlocking projections may be employed. The blocks may be trapezoidal, or some other shape, in cross sectional configuration rather than rectangular, as shown in the drawings.

Various modes of carrying out the invention are contemplated as being within the scope of the following claims particularly pointing out and distinctly claiming the subject matter which is regarded as the invention.

I claim:

1. A backpack frame to flex in use and comprising:

harness members suitable for positioning generally at the shoulders and hips of the user; and at least one frame member extending between said harness members and having its ends affixed thereto, said frame member including a plurality of block-like segments stacked one on top of the other to form an elongated member, said segments being so formed as to permit movement of said segments with respect to each other for allowing said frame member to flex, said frame member having means for retaining said segments contiguous so as to form said frame member into an integral structure.

2. The backpack frame according to claim 1 wherein said segments are formed to permit angular movement with repect to one another.

3. The backpack frame according to claim 2 wherein said segments are formed to permit angular movement about axes generally perpendicular to the elongation of said frame member.

4. The backpack frame according to claim 2 wherein said segments are formed to permit angular movement about an axis generally parallel to the elongation of said frame members.

5. The backpack frame according to claim 1 wherein said frame member is connected to said harness members in a manner permitting movement between said harness members and frame member.

6. The backpack frame according to claim 1 wherein said segments have means for mutually engaging adjacent segments in the integral structure while allowing said frame member to flex.

7. The backpack frame according to claim 6 wherein said segments have a projection on one end thereof and a depression on the other end for engaging with adjacent segments.

8. The backpack frame according to claim 7 wherein said segments have a generally prismatic-like projection on one end thereof and a generally prismatic-like depression on the other end thereof for engaging with adjacent segments.

9. The backpack frame according to claim 6 wherein said shape of said mutual engagement means is selected in accordance with the desired stiffness of said frame.

10. The backpack frame according to claim 1 wherein, at least in the central portion of said frame member, the segments of said frame member are of the same configuration.

11. The backpack frame according to claim 1 wherein at least one of said segments in said frame member is different in configuration from another of said segments.

12. The backpack frame according to claim 10 wherein at lease one of said segments is curved and one of said segments is straight.

13. The backpack frame according to claim 10 wherein at least one of said segments in said frame member differs in length from another of said segments.

14. The backpack frame according to claim 10 wherein said segments have means for mutually engaging adjacent segments in said structure while allowing said frame member to flex and wherein said engaging means is formed to position said segments in different relative angular relationships in different portions of said frame member.

15. The backpack frame according to claim 1 wherein said retaining means is further defined as compressively loading said segments to retain them in the integral structure.

16. The backpack frame according to claim 15 wherein said retaining means is further defined as adjustably compressively loading said segments.

17. The backpack frame according to claim 15 wherein said retaining means comprises a tensioned cord extending through said segments.

18. The backpack frame according to claim 17 further defined as including a pair of spaced frame members extending between said harness members and wherein said cord comprises a single cord extending through both frame members.

19. The backpack frame according to claim 18 wherein said backpack frame is so formed that the tensioning of said cord biases said frame members into generally perpendicular position with respect to said harness members.

20. The backpack frame according to claim 18 wherein said cord extends twice through said segments generally in a direction parallel to the elongation of said frame member.

21. The backpack frame according to claim 18 further including means for adjustably tensioning the cord to compressively load said segments.

22. The backpack frame according to claim 1 wherein said retaining means has an elasticity selected in accordance with the desired stiffness of said frame.

23. The backpack frame according to claim 1 further including a sleeve surrounding said frame member.

24. The backpack frame according to claim 23 for carrying a pack mounted on the frame and wherein the pack has said sleeve surrounding said frame member.

25. The backpack frame according to claim 23 wherein said sleeve contains elastic means for compressively loading said segments.

26. The backpack frame according to claim 1 wherein said harness members are flexible.

27. A backpack frame adapted to flex in use and comprising:

harness members suitable for positioning generally at the shoulders and hips of the user; and at least one frame member extending between said harness members and having its ends affixed thereto, said frame member including a plurality of block-like segments stacked one on top of the other to form a generally column-like structure, said segments being so formed as to permit movement of said segments with respect to each other for allowing said frame member to flex, said frame member having a tensioned cord extending through said segments for retaining said segments contiguous so as to form said frame member into the integral column-like structure.

28. The backpack frame according to claim 27 further defined as including a pair of spaced frame members extending between said harness members.

29. The backpack frame according to claim 1 wherein said segments are stacked one on top of the other to form a column extending between said harness members.

30. The backpack frame according to claim 29 further defined as including a pair of spaced frame members extending between said harness members.

31. The backpack frame according to claim 14 wherein said frame members are movable with respect to said harness members to alter the spacing between said frame members.

* * * * *